US008770990B2

(12) United States Patent
Sytsma et al.

(10) Patent No.: US 8,770,990 B2
(45) Date of Patent: Jul. 8, 2014

(54) PLUG CONNECTOR WITH IMPROVED CONSTRUCTION

(75) Inventors: Peter H. Sytsma, Maumelle, AR (US); Dennis L. Doye, Maumelle, AR (US); Bruce A. Reed, Maumelle, AR (US); John Reginald Crane, Little Rock, AR (US); Brian Keith Lloyd, Maumelle, AR (US); Keith Lang, Cary, IL (US)

(73) Assignee: Molex Incorporated, Lisle, IL (US)

( * ) Notice: Subject to any disclaimer, the term of this patent is extended or adjusted under 35 U.S.C. 154(b) by 105 days.

(21) Appl. No.: 13/635,811

(22) PCT Filed: Mar. 21, 2011

(86) PCT No.: PCT/US2011/029236

§ 371 (c)(1),
(2), (4) Date: Nov. 13, 2012

(87) PCT Pub. No.: WO2011/116390

PCT Pub. Date: Sep. 22, 2011

(65) Prior Publication Data

US 2013/0231011 A1 Sep. 5, 2013

Related U.S. Application Data

(60) Provisional application No. 61/315,801, filed on Mar. 19, 2010.

(51) Int. Cl.
*H01R 12/00* (2006.01)

(52) U.S. Cl.
USPC ..... 439/76.1

(58) Field of Classification Search
CPC ..... H01R 13/6658
USPC ..... 439/76.1
See application file for complete search history.

(56) References Cited

U.S. PATENT DOCUMENTS

| | | | | |
|---|---|---|---|---|
| 6,280,209 | B1 | 8/2001 | Bassler et al. | |
| 6,371,793 | B1 | 4/2002 | Doorhy et al. | |
| 7,618,264 | B2 * | 11/2009 | Wu | 439/76.1 |
| 7,651,341 | B2 * | 1/2010 | Wu | 439/76.1 |
| 7,651,342 | B1 * | 1/2010 | Wu | 439/76.1 |
| 7,654,831 | B1 * | 2/2010 | Wu | 439/76.1 |
| 7,803,010 | B1 * | 9/2010 | Hwang | 439/497 |
| 7,883,341 | B2 * | 2/2011 | Lang et al. | 439/76.1 |
| 7,938,669 | B2 * | 5/2011 | Li et al. | 439/352 |
| 8,147,255 | B2 * | 4/2012 | Wu | 439/76.1 |
| 8,152,555 | B2 * | 4/2012 | Wu | 439/352 |

(Continued)

OTHER PUBLICATIONS

International Search Report for PCT/US2011/029236.

*Primary Examiner* — Ross Gushi
(74) *Attorney, Agent, or Firm* — Timothy M. Morella

(57) ABSTRACT

A plug style connector has an outer connector housing with an internal passage which accommodates a cable assembly. A plurality of multi-wire cables extend through a wire organizer that arranges the cables in a preselected arrangement. Exposed free ends of the conductors of the wires are terminated to multiple circuit boards which are separated in a preselected spacing by a spacer member. The spacer member and wire organizer have flat opposing surfaces that define boundaries of a body portion formed by the application of a hot melt to the cables, the hot melt adheres to the wire organizer and the spacer to hold the cable wires and their associated circuit boards in place for correct insertion into the connector housing.

21 Claims, 19 Drawing Sheets

(56) References Cited

U.S. PATENT DOCUMENTS

| | | | | |
|---|---|---|---|---|
| 8,157,579 | B2 * | 4/2012 | Wu | 439/352 |
| 8,157,580 | B2 * | 4/2012 | Wu | 439/352 |
| 8,187,019 | B2 * | 5/2012 | Reed et al. | 439/345 |
| 8,202,122 | B2 * | 6/2012 | Wu | 439/607.47 |
| 8,241,045 | B2 * | 8/2012 | Reed et al. | 439/76.1 |
| 8,251,730 | B2 * | 8/2012 | Wu | 439/345 |
| 8,251,733 | B2 * | 8/2012 | Wu | 439/352 |
| 8,251,735 | B2 * | 8/2012 | Wu | 439/353 |
| 8,267,713 | B2 * | 9/2012 | Wu | 439/352 |
| 8,292,637 | B2 * | 10/2012 | Wu | 439/76.1 |
| 8,303,314 | B2 * | 11/2012 | Wu | 439/76.1 |
| 8,337,233 | B2 * | 12/2012 | Wu | 439/345 |
| 8,360,799 | B2 * | 1/2013 | Wu | 439/358 |
| 8,366,456 | B2 * | 2/2013 | Wu | 439/76.1 |
| 8,393,913 | B2 * | 3/2013 | Wu | 439/345 |
| 8,414,324 | B2 * | 4/2013 | Reed et al. | 439/345 |
| 8,439,704 | B2 * | 5/2013 | Reed | 439/607.06 |
| 8,475,198 | B2 * | 7/2013 | Wu | 439/352 |
| 8,475,199 | B2 * | 7/2013 | Wang et al. | 439/353 |
| 8,480,432 | B2 * | 7/2013 | Wu | 439/607.18 |
| 8,506,331 | B2 * | 8/2013 | Wu | 439/607.18 |
| 8,523,598 | B2 * | 9/2013 | Wu | 439/358 |
| 8,550,848 | B2 * | 10/2013 | Wu | 439/607.18 |
| 8,573,997 | B2 * | 11/2013 | Neer et al. | 439/345 |
| 2004/0115997 | A1 | 6/2004 | Scherer et al. | |
| 2006/0199434 | A1 | 9/2006 | Chang | |
| 2009/0247017 | A1 * | 10/2009 | Wu | 439/660 |
| 2009/0253292 | A1 * | 10/2009 | Wu | 439/493 |
| 2010/0015851 | A1 * | 1/2010 | Wu | 439/607.01 |
| 2010/0130063 | A1 * | 5/2010 | Lang et al. | 439/607.17 |
| 2010/0203754 | A1 * | 8/2010 | Li et al. | 439/345 |
| 2010/0210131 | A1 * | 8/2010 | Reed et al. | 439/352 |
| 2011/0059645 | A1 * | 3/2011 | Wu | 439/460 |
| 2011/0086548 | A1 * | 4/2011 | Wu | 439/607.41 |
| 2011/0136368 | A1 * | 6/2011 | Wu | 439/345 |
| 2011/0183535 | A1 * | 7/2011 | Wu | 439/153 |
| 2011/0195586 | A1 * | 8/2011 | Wu | 439/152 |
| 2011/0195590 | A1 * | 8/2011 | Wu | 439/345 |
| 2011/0195595 | A1 * | 8/2011 | Wu | 439/370 |
| 2011/0195614 | A1 * | 8/2011 | Wu | 439/676 |
| 2011/0212643 | A1 * | 9/2011 | Reed et al. | 439/345 |
| 2011/0223809 | A1 * | 9/2011 | Reed et al. | 439/626 |
| 2011/0237112 | A1 * | 9/2011 | Wu | 439/358 |
| 2011/0250778 | A1 * | 10/2011 | Wu | 439/345 |
| 2011/0256776 | A1 * | 10/2011 | Reed | 439/660 |
| 2011/0281455 | A1 * | 11/2011 | Wu | 439/345 |
| 2011/0294333 | A1 * | 12/2011 | Wu | 439/345 |
| 2011/0300735 | A1 * | 12/2011 | Wu | 439/345 |
| 2011/0300749 | A1 * | 12/2011 | Sytsma et al. | 439/607.01 |
| 2011/0306228 | A1 * | 12/2011 | Wu | 439/345 |
| 2011/0306244 | A1 * | 12/2011 | Zhang et al. | 439/624 |
| 2012/0015544 | A1 * | 1/2012 | Wu | 439/345 |
| 2012/0015545 | A1 * | 1/2012 | Wu | 439/345 |
| 2012/0040550 | A1 * | 2/2012 | Wu | 439/352 |
| 2012/0040551 | A1 * | 2/2012 | Wu | 439/358 |
| 2012/0040552 | A1 * | 2/2012 | Wu | 439/358 |
| 2012/0064750 | A1 * | 3/2012 | Wu | 439/345 |
| 2012/0064779 | A1 * | 3/2012 | Wu | 439/676 |
| 2012/0094515 | A1 * | 4/2012 | Wu | 439/159 |
| 2012/0129396 | A1 * | 5/2012 | Wang et al. | 439/607.01 |
| 2012/0171903 | A1 * | 7/2012 | Wang et al. | 439/660 |
| 2012/0214324 | A1 * | 8/2012 | Wu | 439/271 |
| 2012/0214327 | A1 * | 8/2012 | Reed et al. | 439/345 |
| 2012/0214345 | A1 * | 8/2012 | Wu | 439/607.19 |
| 2012/0214350 | A1 * | 8/2012 | Wu | 439/676 |
| 2012/0264325 | A1 * | 10/2012 | Reed et al. | 439/345 |
| 2013/0005173 | A1 * | 1/2013 | Reed et al. | 439/350 |
| 2013/0095676 | A1 * | 4/2013 | Wu | 439/76.1 |
| 2013/0231011 | A1 * | 9/2013 | Sytsma et al. | 439/723 |

* cited by examiner

PLUG CONNECTOR WITH IMPROVED CONSTRUCTION

BACKGROUND OF THE PRESENT DISCLOSURE

The Present Disclosure relates generally to the construction of plug connectors and, more particularly, to high-speed plug connectors having improved impedance characteristics.

Many different styles of cable connectors are known. One such connector is described in U.S. Pat. No. 7,175,444, the contents of which are incorporated by reference herein in its entirety. In the connector disclosed in the '444 patent, cable wires are connected to contact pads on a printed circuit board used as a mating blade of the connector. The wires are terminated to the contact pads in a termination nest area and then overmolded with plastic. The plastic has a higher dielectric constant than air and, as such, affects the impedance of the connector, typically by lowering it in that area. The resultant dip in impedance may be detrimental to the operation of the connector based upon its magnitude. At low operational speeds and data transmission rates, such as 1 Gbs, an impedance dip of greater than 8-10 ohms may not introduce excessive noise into the connector. However, at higher speeds and data transmission rates, such as upwards to about 8-12 Gbs, noise rises to a level where it becomes an issue. Large dips in impedance are conducive to the introduction of noise into the connector as well as crosstalk.

However, the use of plastic overmolding is desirable because it provides a reliable means for locating the wires and the circuit boards within an exterior housing, as well as forming a unitary connector structure. Additionally, plastic overmolding also provides strain relief which protects the joined or soldered connections to the printed circuit boards from direct pull forces on the cable. Further, removing the overmolded section leads to a non-unitary structure.

The Present Disclosure is therefore directed to a plug connector that has a desirable impedance profile, as well as one with a robust connector structure.

SUMMARY OF THE PRESENT DISCLOSURE

It is an object of the Present Disclosure to provide a plug connector construction which improves the impedance profile thereof, while still maintaining a robust structure therefor.

In this regard, the connectors, as described herein, include a plurality of wire cables with some of the cables including pairs of signal wires and a drain wire. A wire organizer is provided that slips over individual wires to snugly grip the wires. This wire organizer defines a rear wall or portion of the connector assembly that is insertable into an outer housing. The wires have free ends which expose thin inner conductors that are terminated to contact pads on multiple circuit boards. In the preferred execution of the connector, two circuit boards, or cards are utilized.

A spacer element is further provided and firstly spaces the multiple circuit boards apart from each other in the vertical direction. Secondly, certain other aspects are provided in the spacer structure so that when it is assembled to the circuit boards, it orients the circuit boards for proper insertion as a assembly into an exterior connector housing, as well as for mating to an opposing, mating connector. Thirdly, as the spacer is positioned a preselected distance from the wire organizer, it has a rear face that defines a first boundary of a body portion formed from a holt melt (typically a thermosetting adhesive) applied to the cables, while the wire organizer has a front face that defines a second boundary of this body portion. In this manner, the wire organizer and the spacer cooperatively define the boundaries of the body portion.

When the body portion is formed over the cables between the wire organizer and spacer, it fixes the wires in place and forms, in cooperation, with the organizer and spacer, a cable assembly in which the wires are terminated to the circuit boards, which are held in their desired spacing. The exposed ends of the conductors of the wires are terminated to corresponding contact pads on the circuit boards, but the hot melt does not envelop the conductor terminations. Thus, the terminations and their associated conductors are enveloped by air. The lower dielectric constant of air, as compared to the hot melt or a plastic, reduces the capacitance of the connector system at the termination. This rise in capacitance results in a lesser drop in impedance than if the body portion were permitted to flow over the conductor terminations, thus reducing a large dip in the impedance profile which could impart detrimental noise at high data speeds.

The completed cable assembly is insertable into a hollow exterior connector housing that encloses the front (or mating) ends of the circuit boards. The spacer is preferably provided with polarizing features for the entire assembly that permit the assembly only to be inserted into the outer housing in the proper orientation. Furthermore, both the organizer and the spacer may be provided with engagement members in the form of lugs, or catches, that engage complimentary-shaped recesses, or opening, formed in the outer housing.

Further, a multiple connector housing, such as a tandem connector housing, is provided and includes a structure that permits the insertion of two cable subassemblies therein. An insertable wall member is provided that slips into a slot formed in the interior of the outer connector housing. This wall member has one or more latch openings formed therein to engage the latches or catches formed as part of the cable subassemblies. Thus, multiple connectors may be made by modifying the housing to receive the desired number of cable subassemblies.

These and other objects, advantages and benefits of the disclosure will become apparent in a reading of the following detailed description.

BRIEF DESCRIPTION OF THE DRAWINGS

Throughout the Present Disclosure, reference will be made to the drawings in which like reference numbers identify like elements, and in which.

DETAILED DESCRIPTION OF THE PRESENT DISCLOSURE

Figure 1:
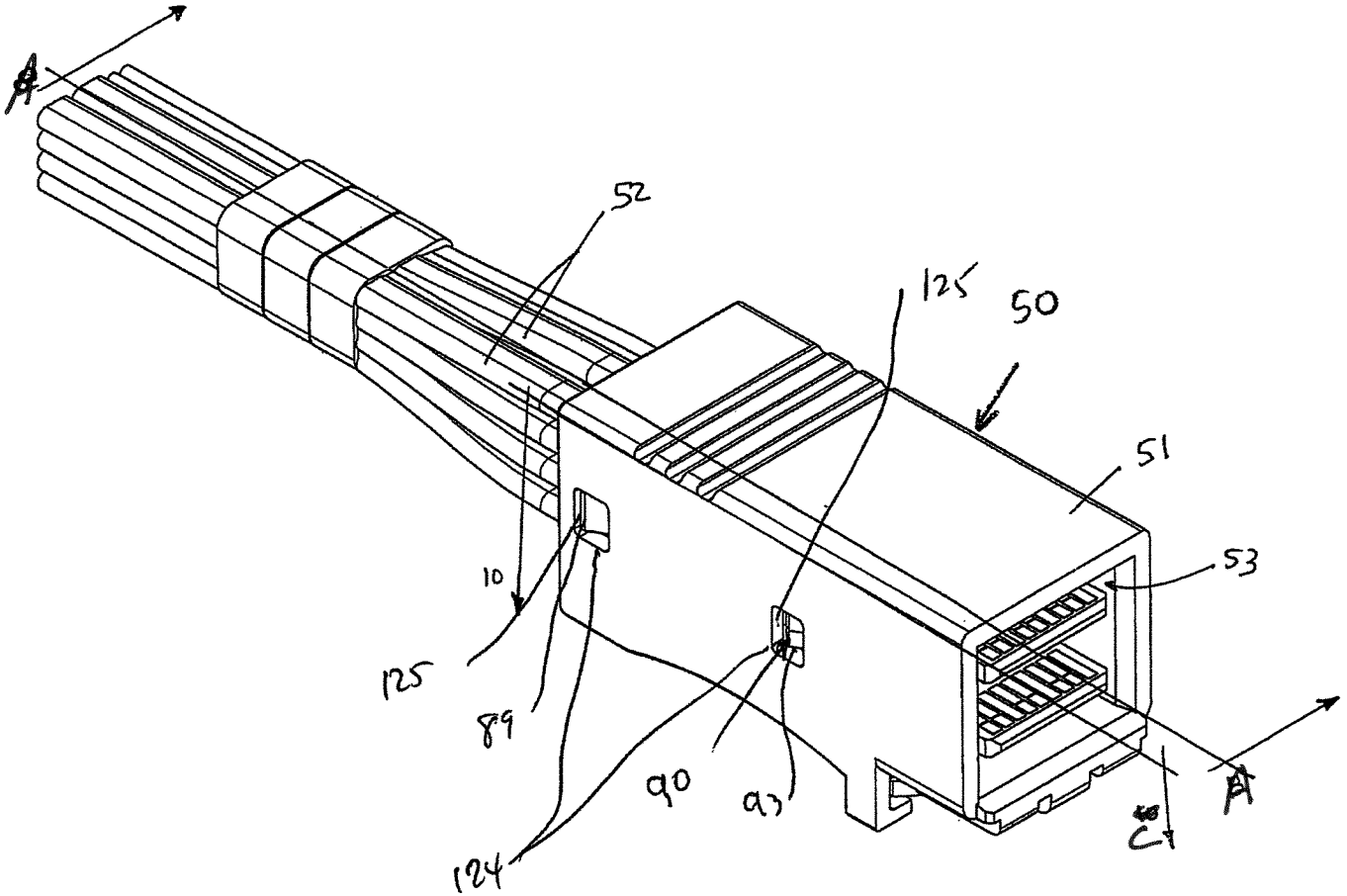
FIG. 1 is a perspective view of a plug connector of the Present Disclosure.
Figure 2:
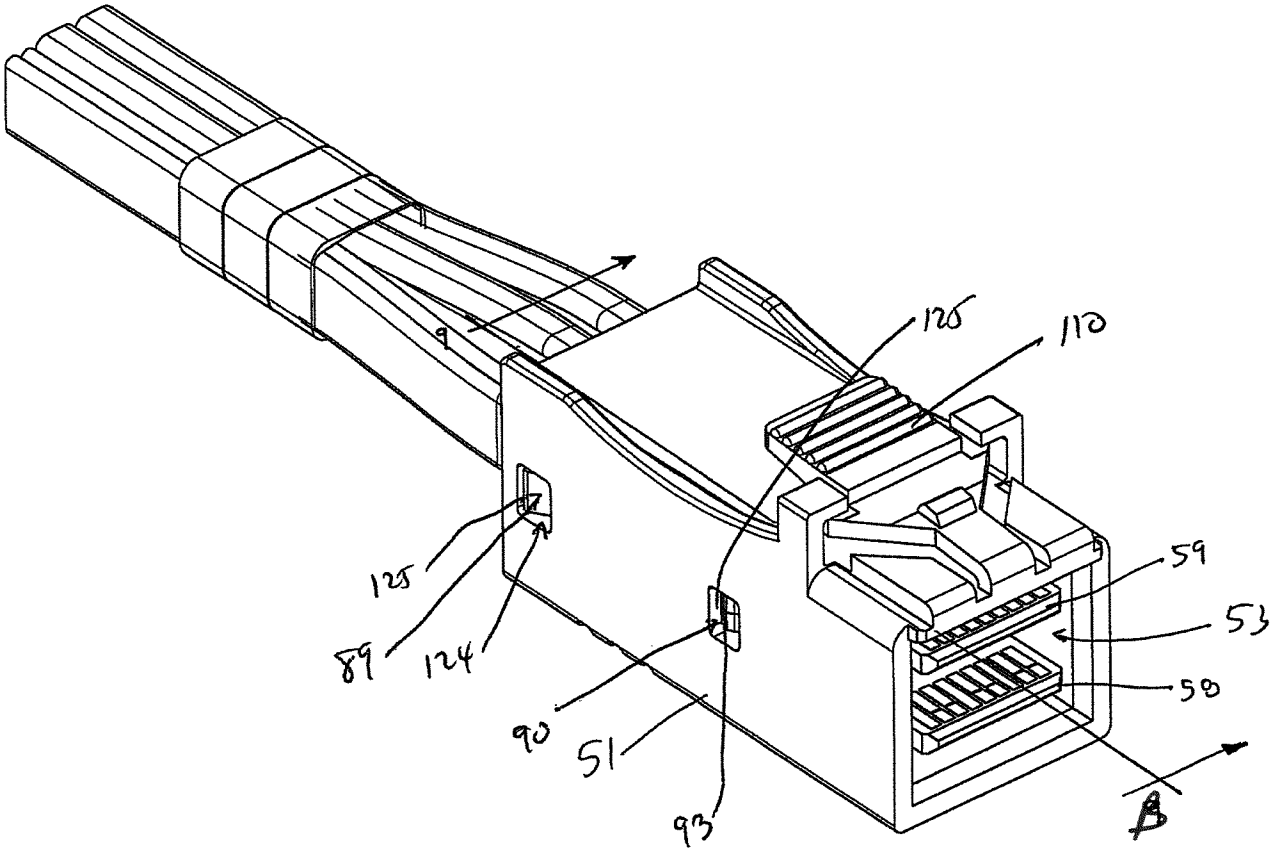
FIG. 2 is an inverted perspective view of the plug connector of FIG. 1.
Figure 3:
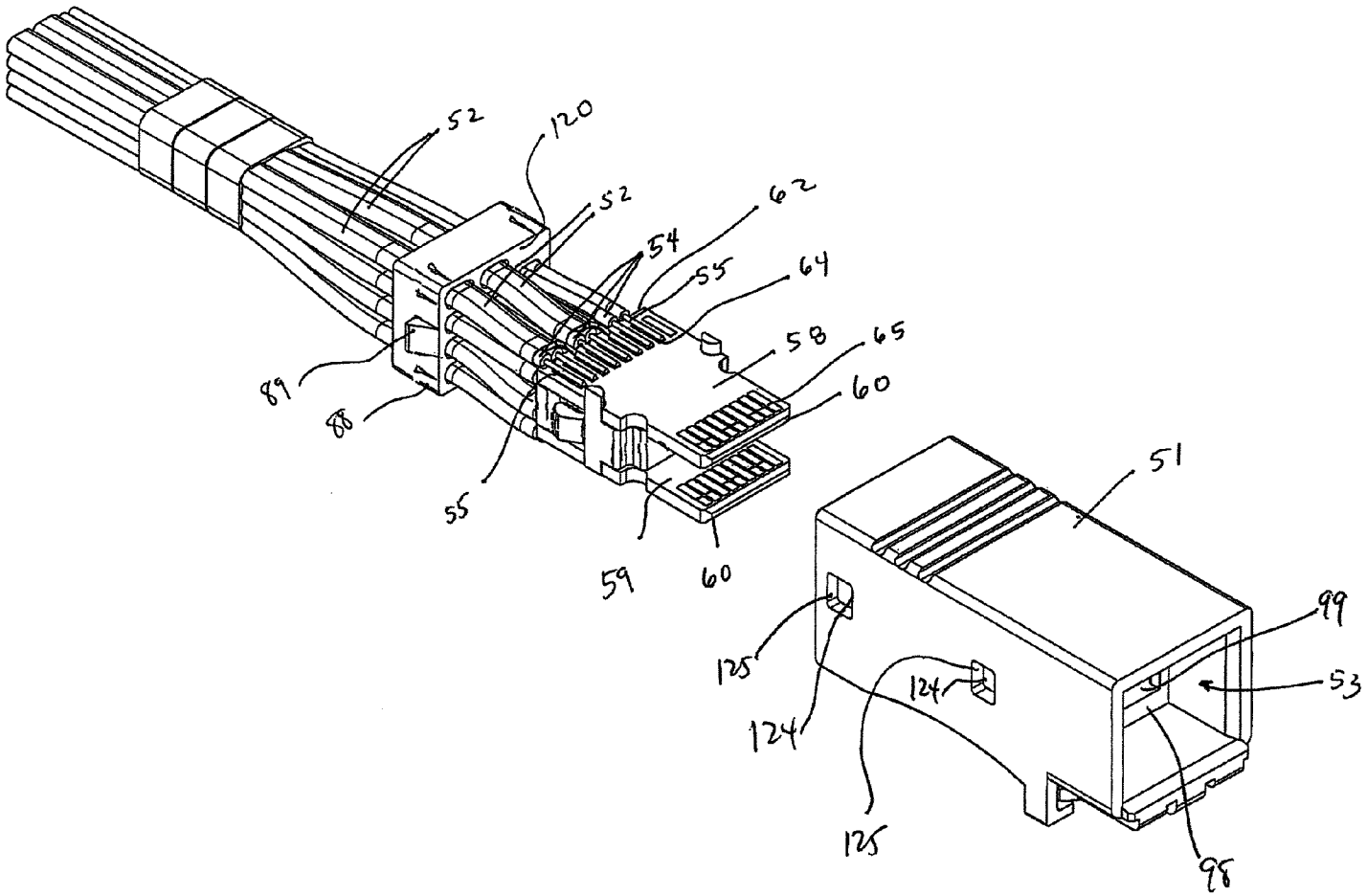
FIG. 3 is a partially exploded view of the plug connector of FIG. 1, with the internal cable-circuit board assembly and the body portion removed from the connector housing.
Figure 3A:
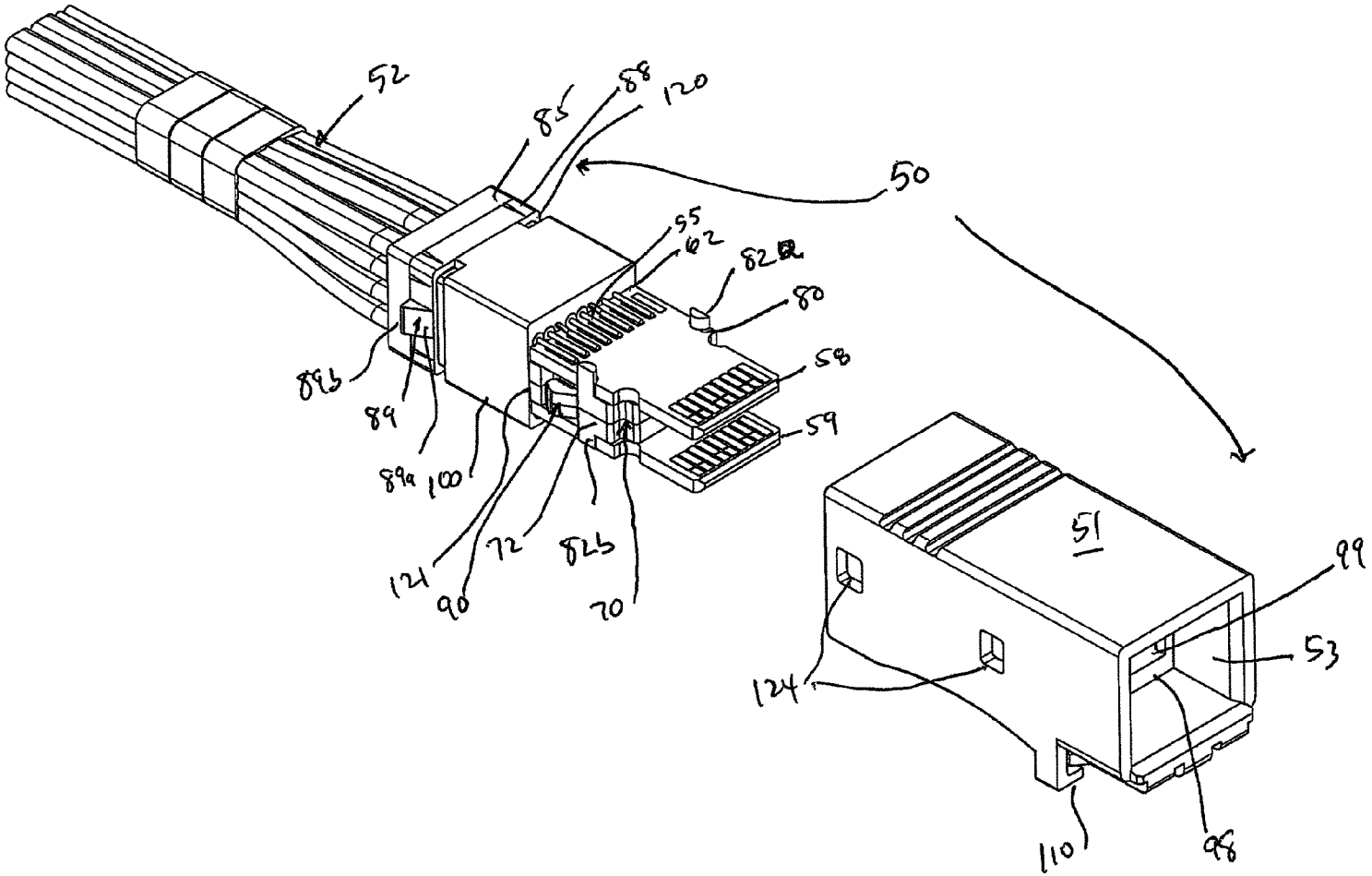
FIG. 3A is the same view as FIG. 3, with the body portion applied to the cables.

FIG. 1 illustrates a plug connector 50 constructed in accordance with the following detailed disclosure. The connector 50 is a plug style connector that is used to electrically connect a plurality of multi-wire cables 52, each containing multiple wires 54 with associated conductors 55. Some of the cables contain pairs of wires which are used to transmit differential signals across the wire pairs. As such, the cables 52 are referred to in the art as "twinax" cables that are used to transmit differential signals, and each such wire pair includes an associated ground, or drain wire 56. The wires 54 of the cable 52 are terminated to printed circuit boards 58, 59 that are elongated in nature and have a general rectangular configuration. Such printed circuit boards are known in the art as "paddle cards" and each such board has opposing leading and trailing edges, or ends 60, 62. The connector 50 includes an elongated hollow connector housing 51 with a hollow passage 53 extending therethrough in a longwise fashion into which a cable assembly 68 is received.

The connector 50 is shown in a normal orientation with its upper flat surface on the connector housing 51 forming the "top" of the connector and a latching mechanism 110 disposed on the "bottom" of the connector 50. This orientation is for connecting to an electronic device that has a latching engagement surface along the bottom of a mating receptacle of the device. It will be understood that the connectors of this disclosure may be used in applications where the latching mechanism 110 is on disposed on the top of the connector housing 51 and, as such, the terms "top," "bottom," "upper" and "lower" are used to describe the environment in which the connector is used and not intended to be limiting to a particular orientation.

The leading edges 60 of the circuit boards 58, 59 extend forwardly with respect to the connector 50 and serve as mating blades that are received within opposing slots of a mating connector (not shown). Inasmuch as the leading edges 60 of the circuit boards 58, 59 extend forwardly to be received within opposing slots, the connector 50 illustrated is considered as a male, connector having a plug end which can be inserted and removed from a mating connector repeatedly. The mating connector may be a singular connector, that is, receiving only a single plug, or it may receive multiple plugs as described herein below.

The circuit boards 58, 59 have contact pads disposed on their exterior surfaces proximate to the leading and of trailing edges 60, 62. The contact pads 64 near the trailing edges 62 are termination pads where the free ends of the wire conductors 55 are attached such as by soldering the like, while the contact pads 65 near the leading edges 60 of the circuit boards are mating pads that are contacted by terminals of the mating connector (not shown). The two sets of contact pads 64, 65 are spaced apart from each other longitudinally of the circuit boards 58, 59 and are connected to each via conductive circuitry of the boards as is known in the art. The circuit boards 58, 59 are further spaced apart from each other in the vertical direction so that they may be accommodated in similarly spaced apart slots of a mating connector.

Figure 4:
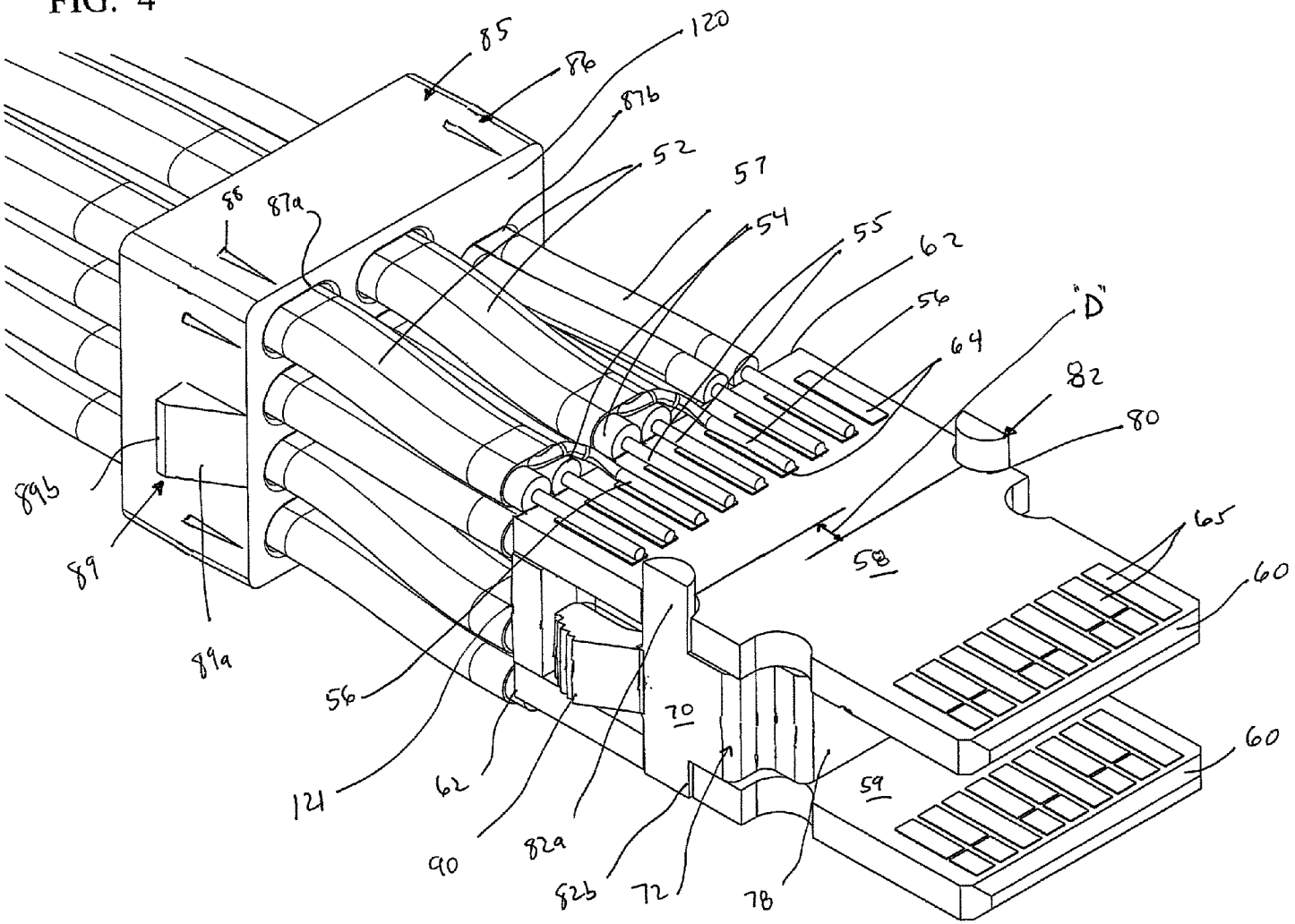
FIG. 4 is an enlarged view of the front end of the circuit board assembly of FIG. 3.
Figure 5:
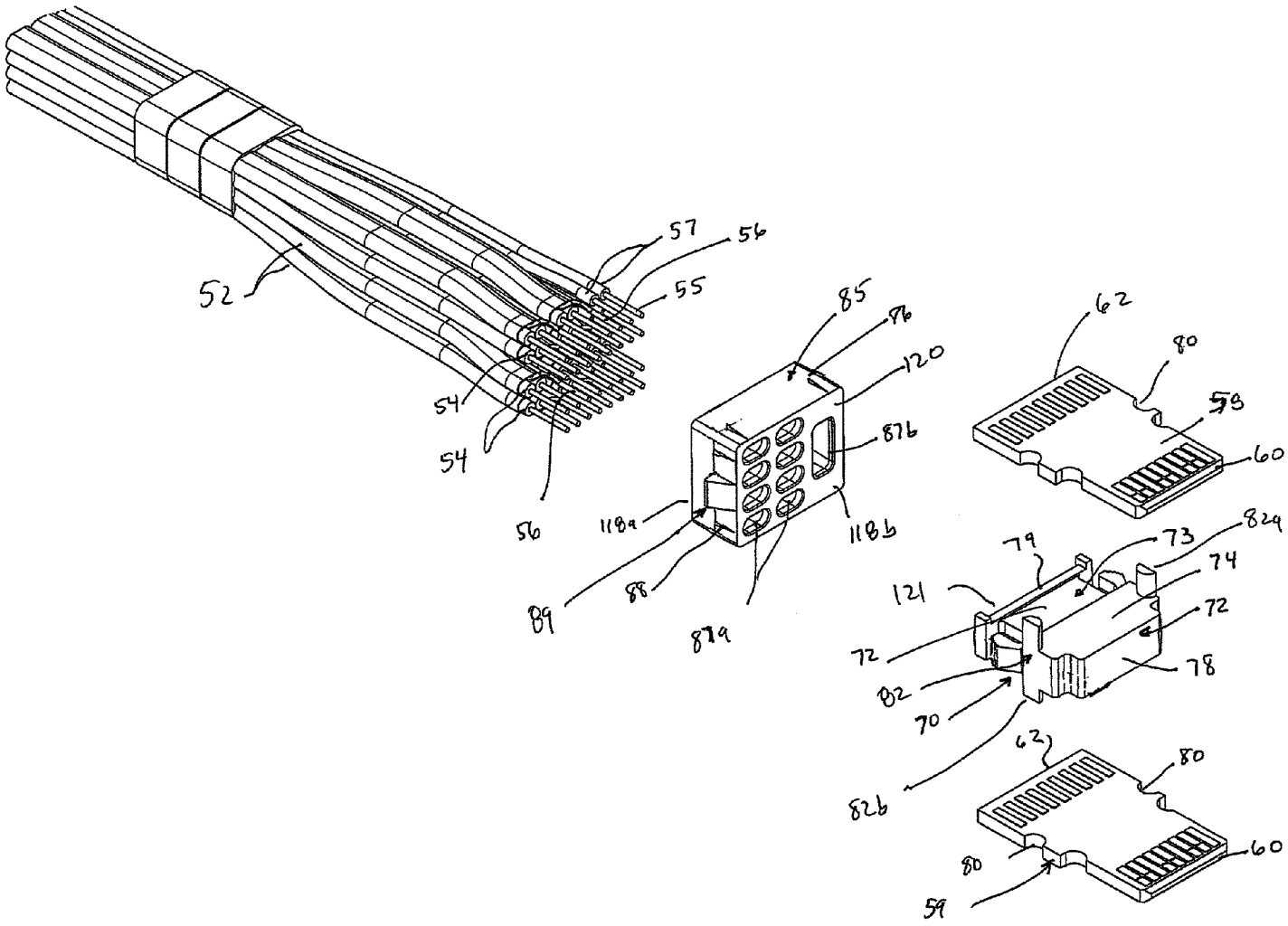
FIG. 5 is the same view as FIG. 4, but more fully exploded.
Figure 6:
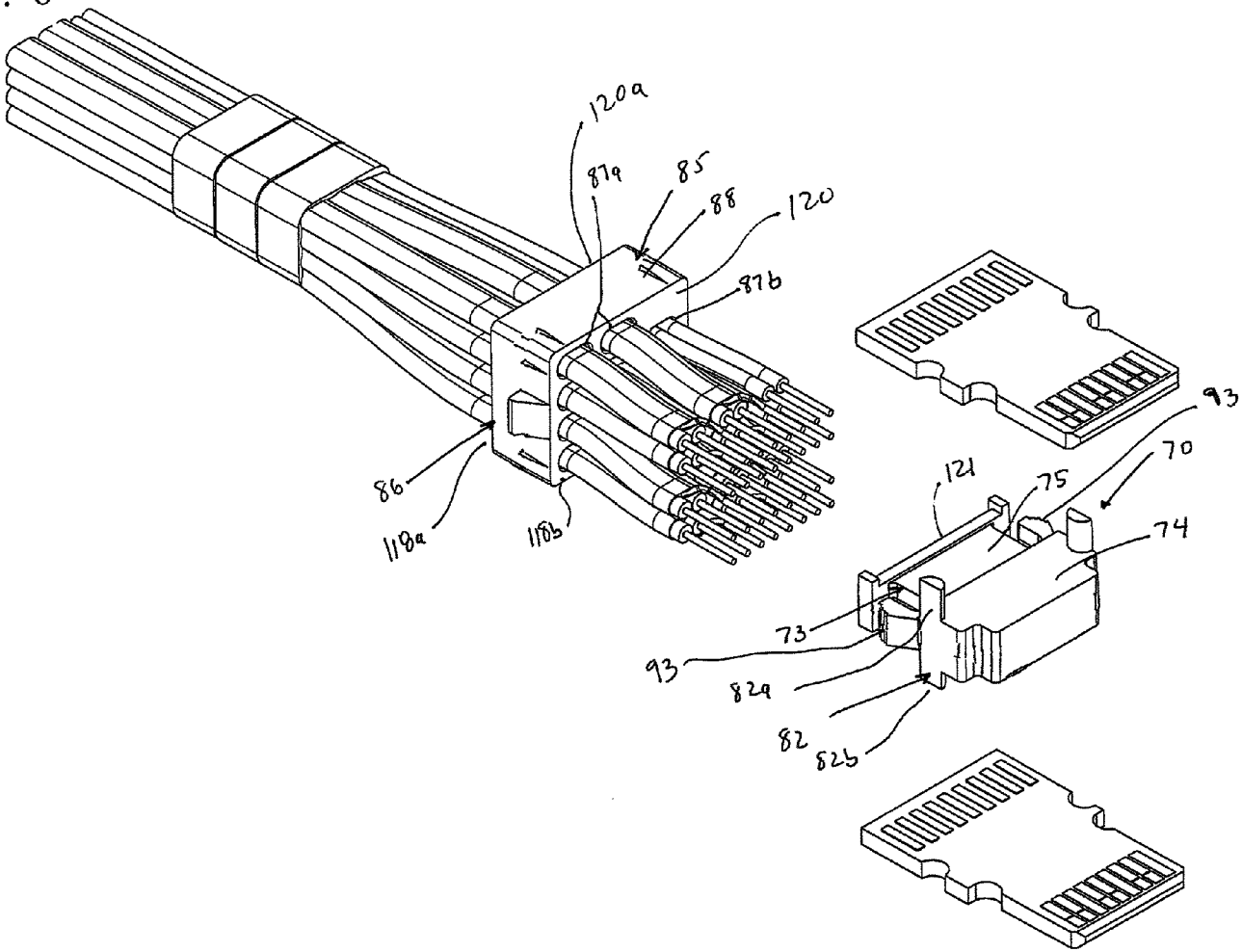
FIG. 6 is the same view as FIG. 4, but with the circuit boards and spacer exploded.
Figure 7A:
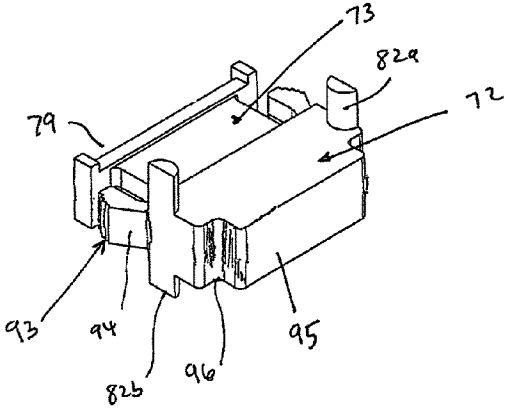
FIG. 7A is a perspective view of the spacer and in the plug connector of FIG. 1.

A spacer 70, as shown best in FIGS. 4-6, is provided in order to define a preselected vertical spacing between the circuit boards 58, 59. The spacer 70 has a stepped profile as shown best when viewing FIGS. 7A and 8, with a base portion 72 followed by a tail portion 73. The tail portion 73 has a thickness less than that of the base portion 72 so as to define two recesses rearward of and adjacent to the base portion 72. The base portion 72 has two opposing flat surfaces 74 which respectively support the top and bottom circuit boards 58, 59 in a preselected vertical spacing so that the circuit boards 58, 59 will be received within opposing slots of a mating connector (not shown). The tail portions 73 likewise have flat opposing surfaces 75 that are spaced apart from each other and the base portion flat surfaces 74 to define, in effect, two recesses 77 in which the free ends (of the conductors 55) of some of the wires 54 extend, shown as the second row of wires from the top of the wire array of FIG. 6 as indicated at 76. Preferably, the depth of these recesses 77 is sufficient to accommodate the diameter of the wire conductors 55 thereby enabling the circuit boards 58, 59 to fit properly on the base portion flat surfaces 74. Only the free ends of the wire conductors 55 are extended over the tail portion flat surfaces 75, and not any of the wire outer insulation so that the conductor free ends extend over and into contact with the circuit board termination contact pads 64.

Figure 7D:
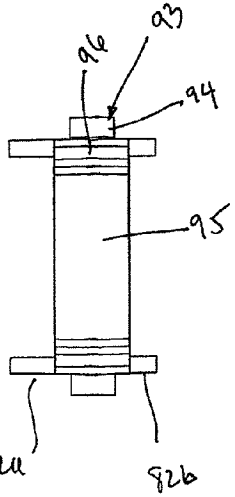
FIG. 7D is a front elevational view of the spacer of FIG. 1.
Figure 7B:
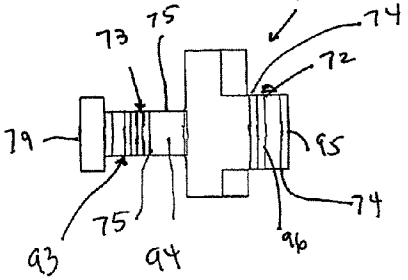
FIG. 7B is an elevational view of the left side of the spacer of FIG. 7A.
Figure 7C:
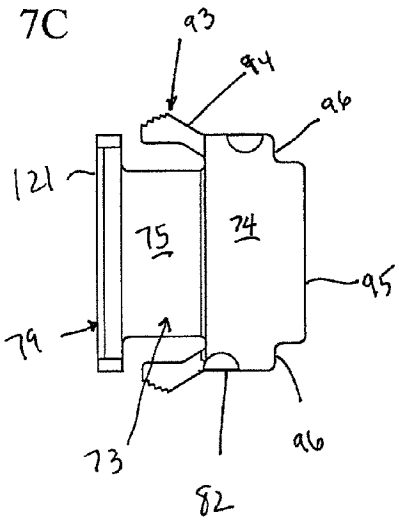
FIG. 7C is a top plan view of the spacer of FIG. 7A.

The spacer 70 also has two opposing front and rear planar surfaces 78, 79. The front surface 78 forms a part of a mating face of the connector in combination with portions of the connector housing 51. The rear surface 79 extends between the two circuit boards and, in combination with other things, forms a stop surface that will be explained in greater detail below. In order to ensure that the circuit boards 58, 59 are assembled in their correct orientation, the circuit boards 58, 59 are preferably provided with notches, or cutouts 80 that engage posts, or lugs, 82*a*-*b* that extend away from the spacer 70, and particularly its base portion 72. The posts 82 are shown projecting upwardly and downwardly from the spacer 70 in the drawings. As can be seen from the drawings, especially FIGS. 4, 7B and 7D, these posts 82 are staggered in the longitudinal direction by a distance D so that the circuit boards 58, 59 can engage and rest upon the spacer 70 only when they are properly oriented for mating with an opposing, mating connector. Whereas the spacer base portion 72 fixes the circuit boards 58, 59 vertically in a preselected, desired spacing, the posts 82*a-b* fix the circuit boards horizontally in their location with respect to the connector housing 51.

Figure 8:
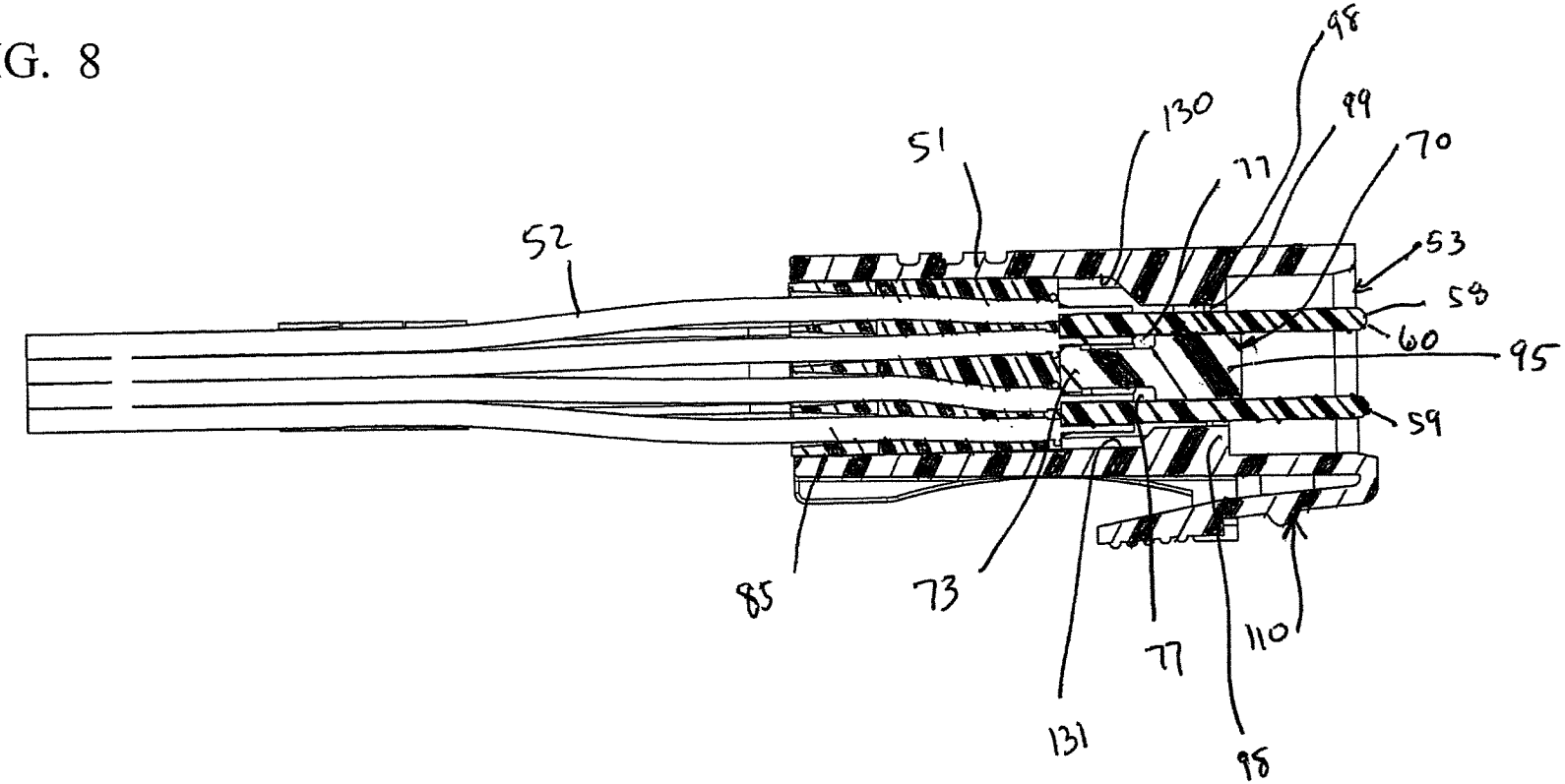
FIG. 8 is a longitudinal sectional view of the plug connector of FIG. 1, along Line A-A.
Figure 9:
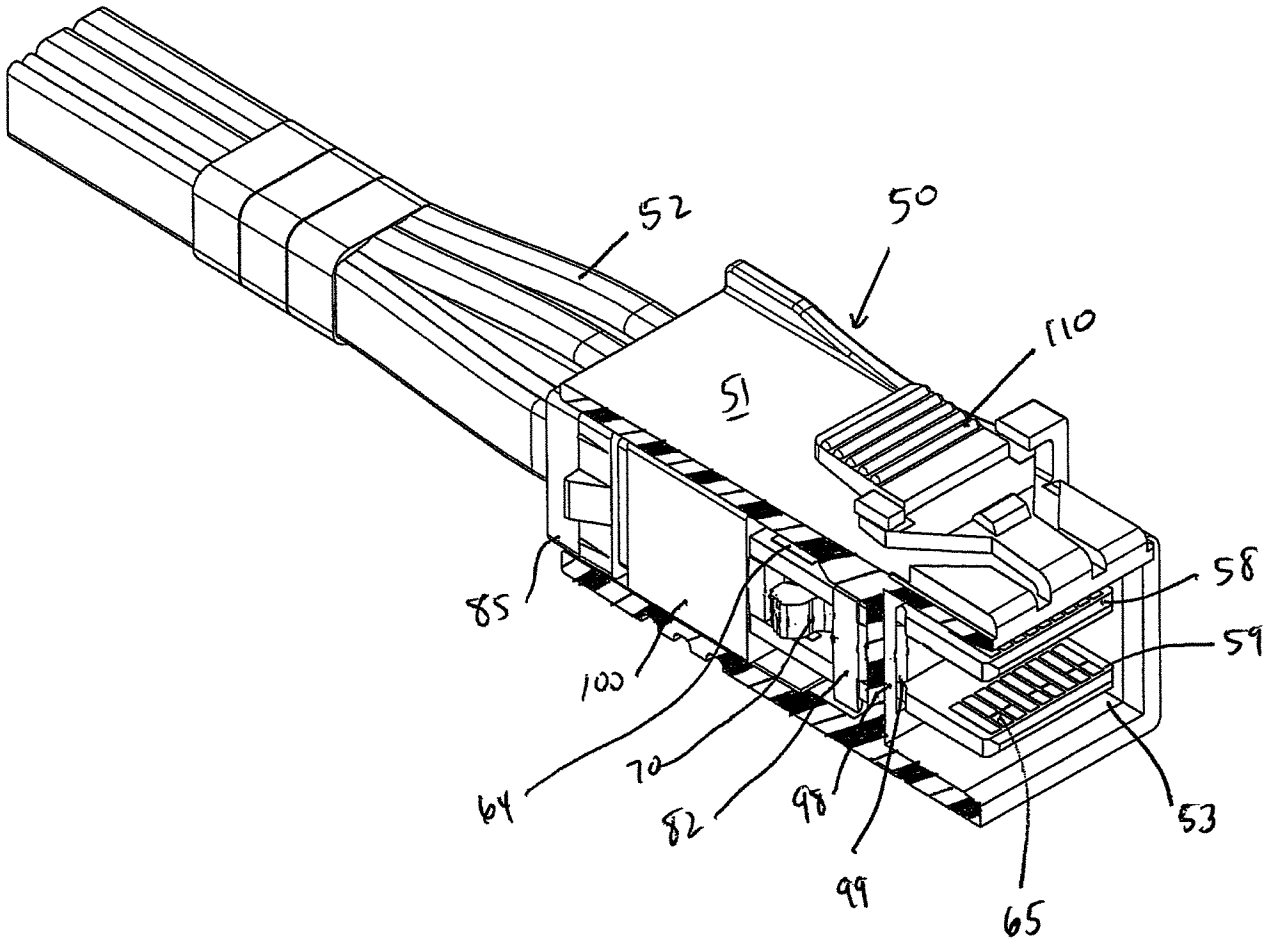
FIG. 9 is a longitudinal sectional view of the plug connector of FIG. 2, along Line B-B.
Figure 10A:
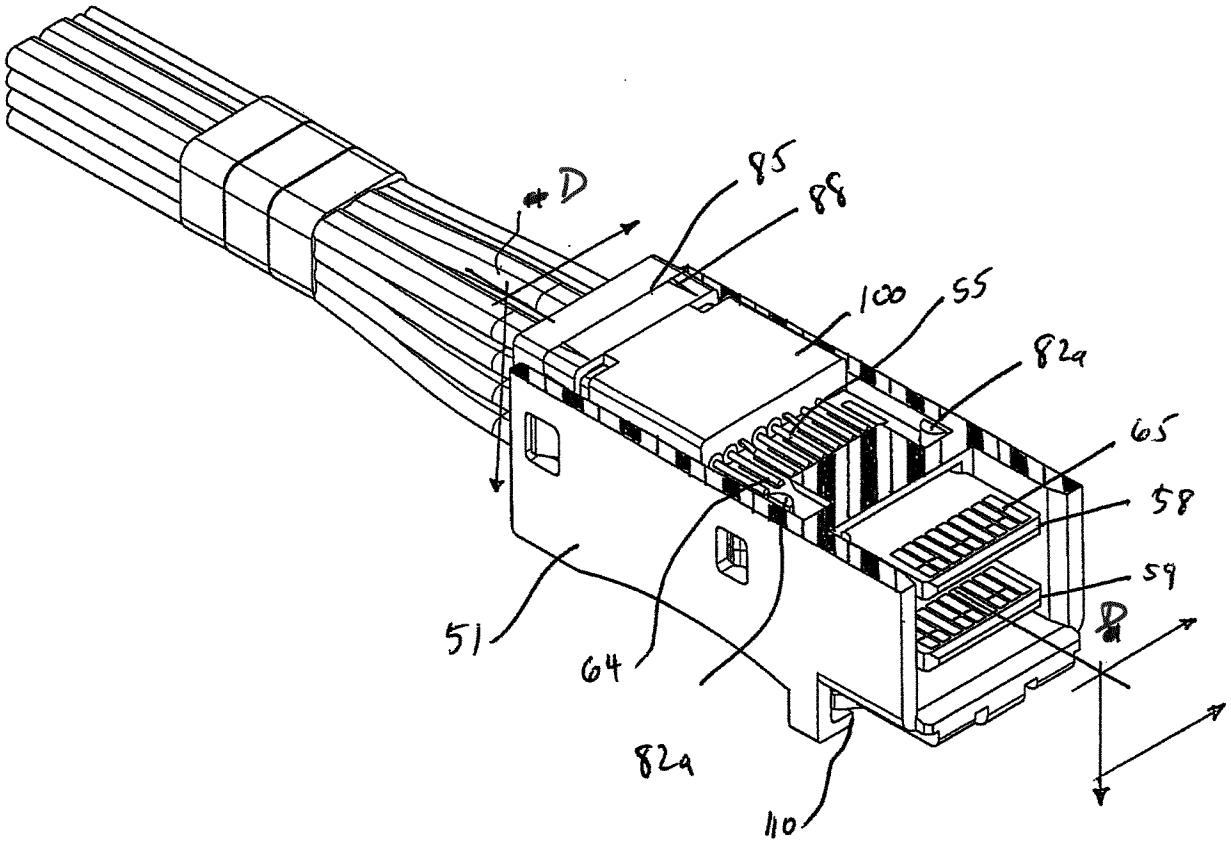
FIG. 10A is a sectional view of the plug connector of FIG. 1, along Line C-C.
Figure 10B:
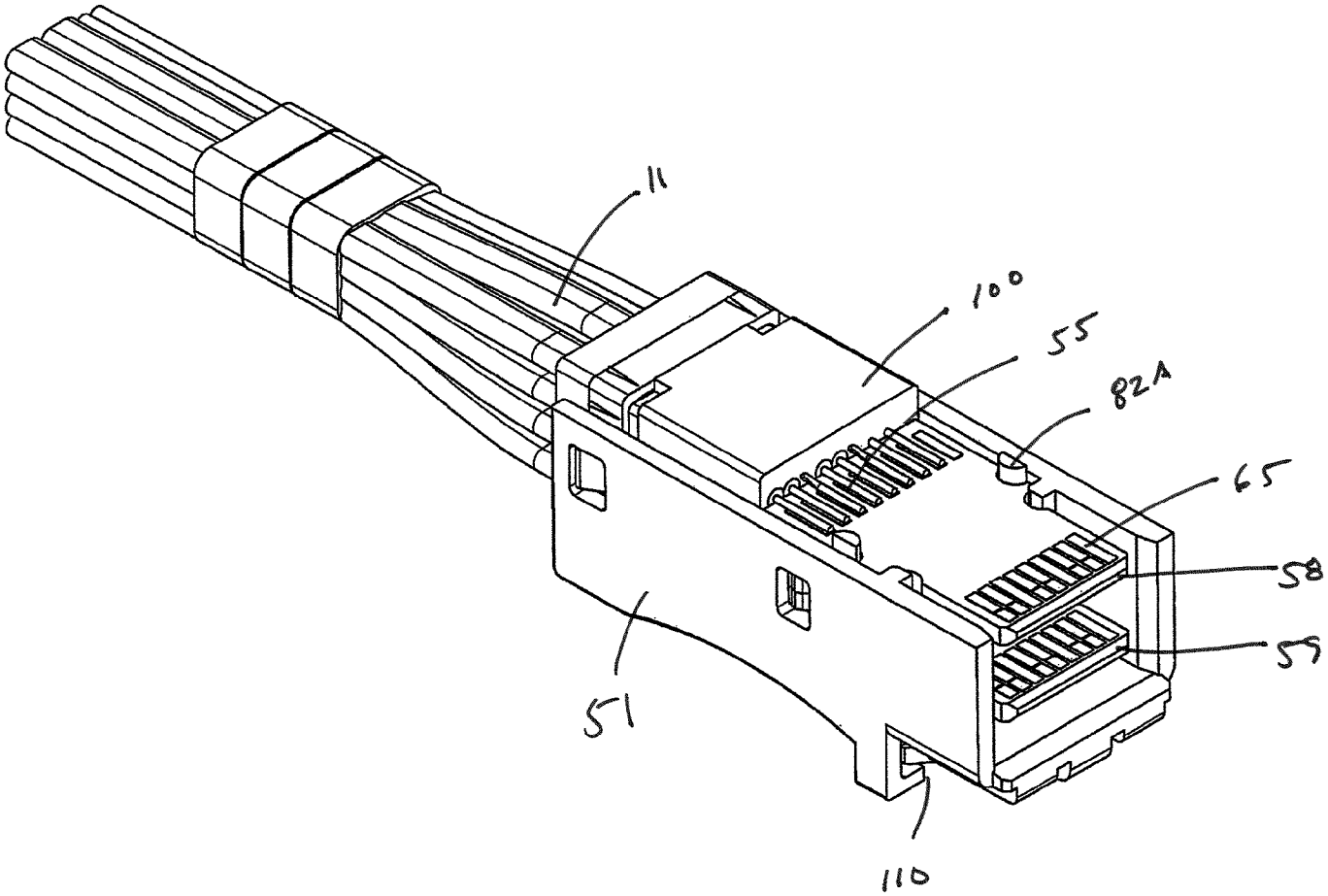
FIG. 10B is the same view as FIG. 10A, but with its section taken along a horizontal plane beneath the upper transverse wall of the outer connector housing.
Figure 11:
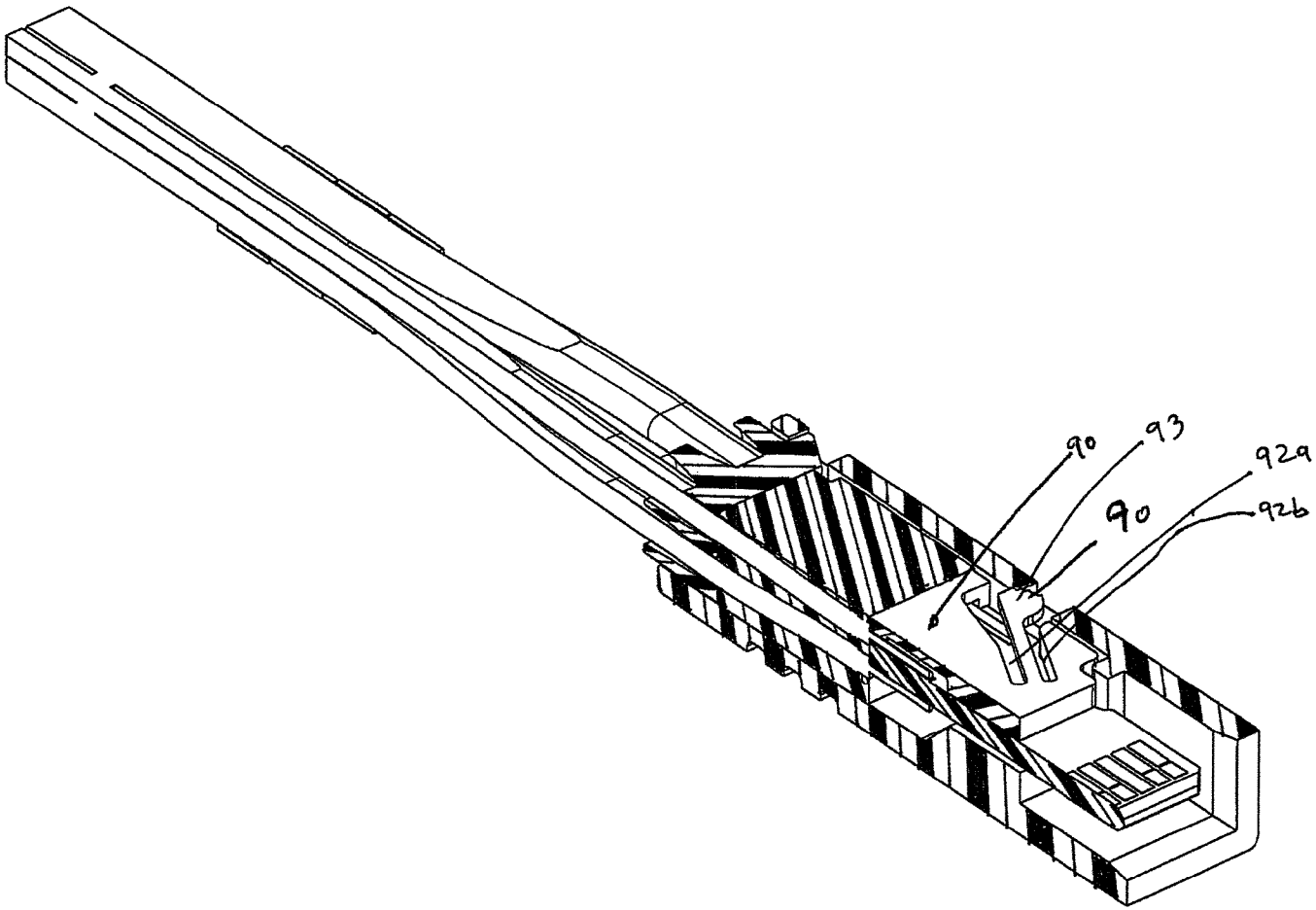
FIG. 11 is a quarter sectional view of the connector of FIG. 10, along Line D-D.
Figure 12:
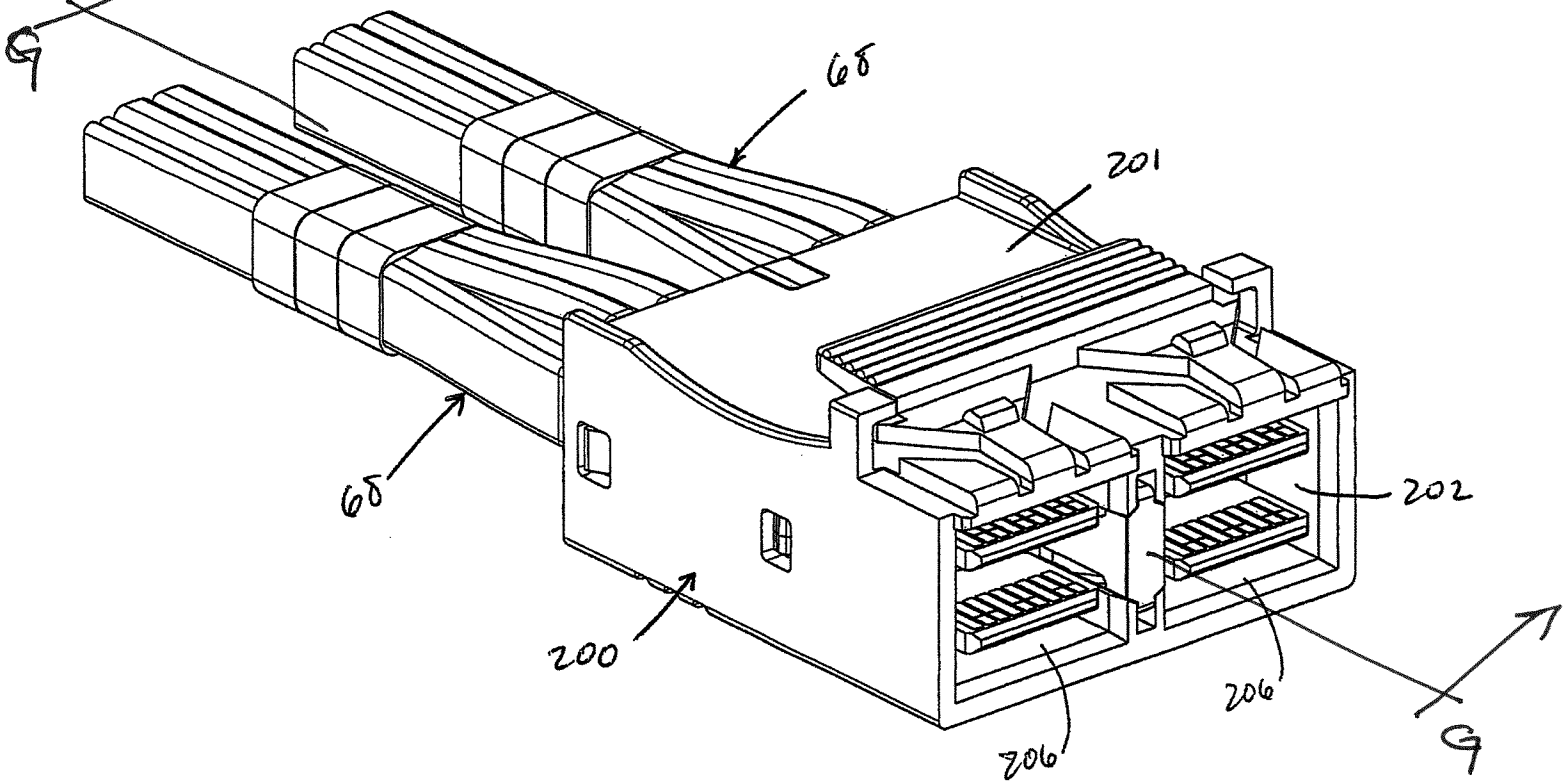
FIG. 12 is a perspective view of a plug connector in a tandem format.
Figure 13:
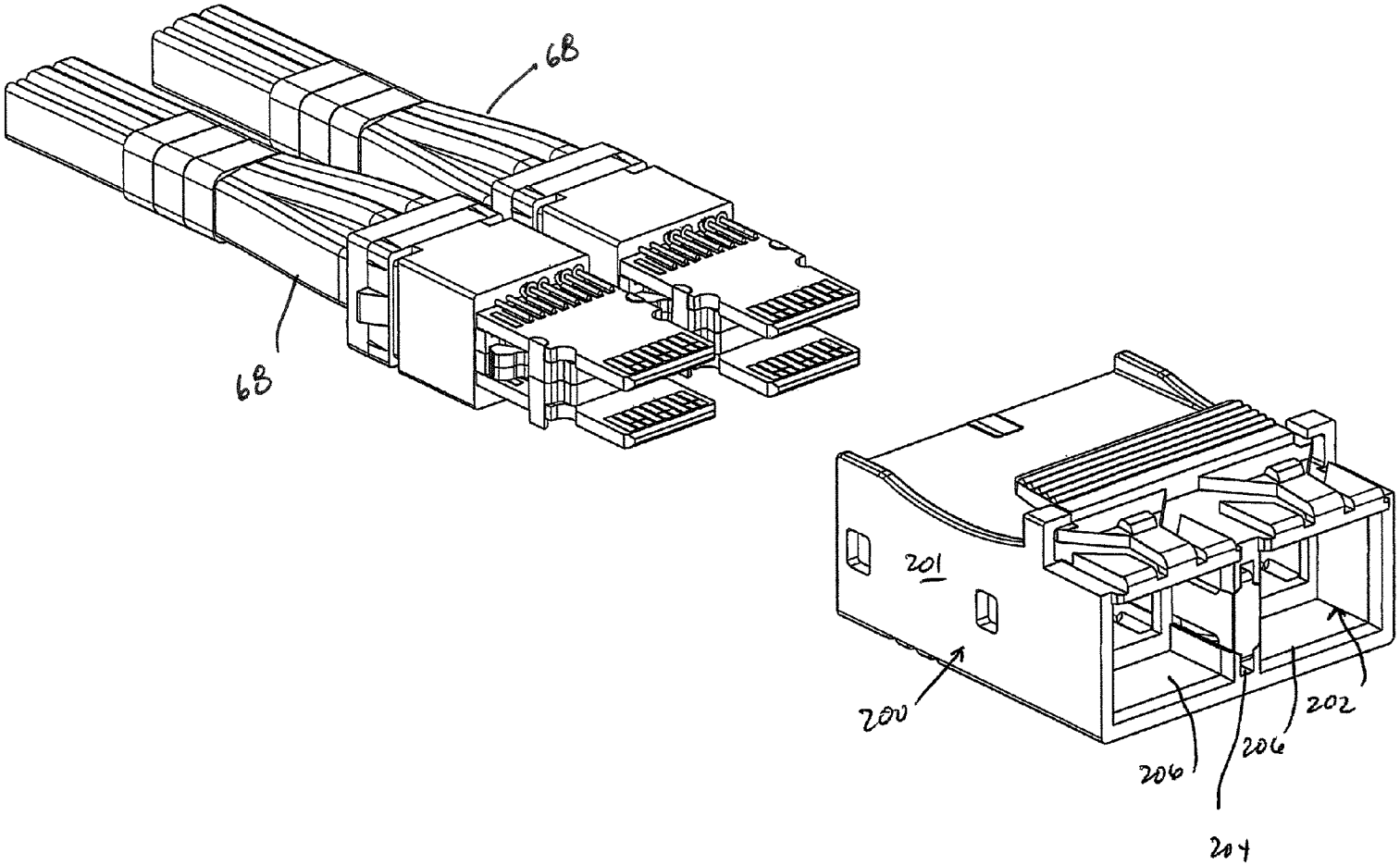
FIG. 13 is the same view as FIG. 12, but with the cable assembly removed for clarity.
Figure 14A:
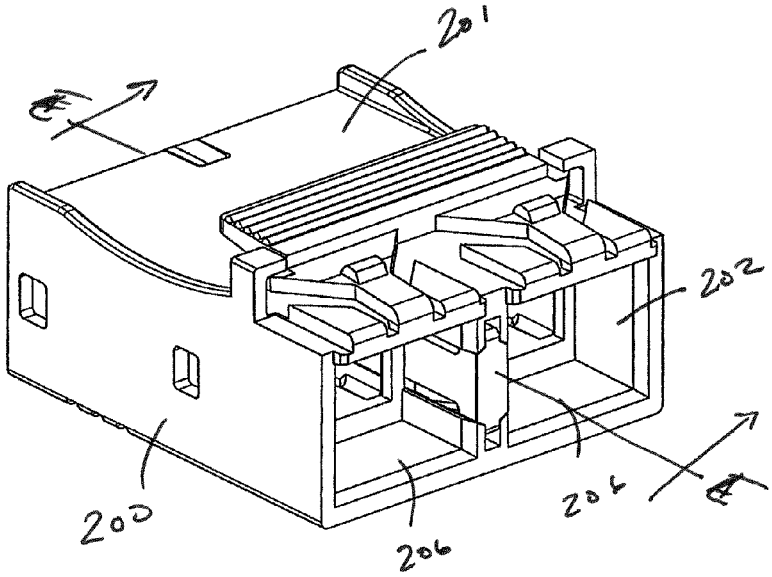
FIG. 14A is a perspective view of the tandem housing of the plug connector of FIG. 12.
Figure 14B:
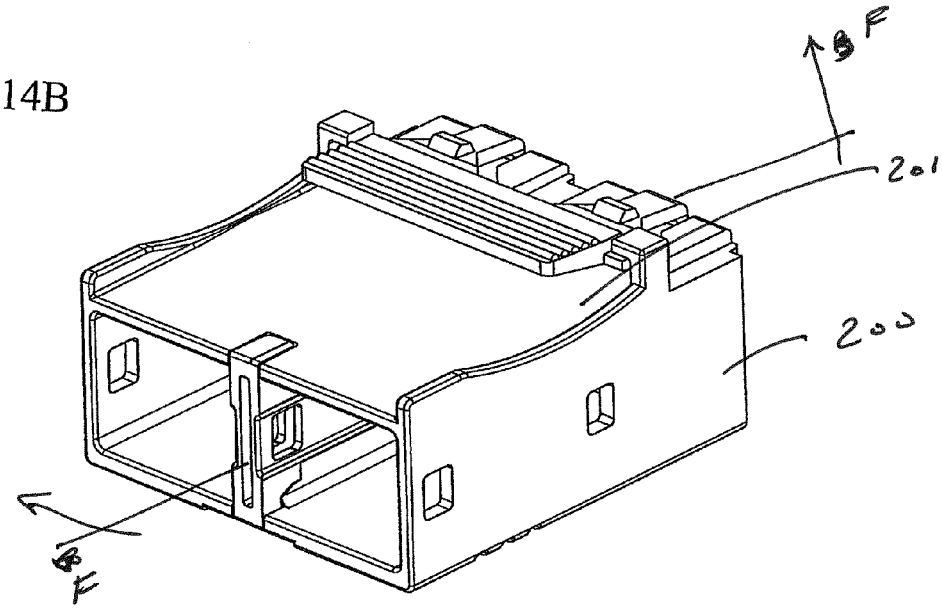
FIG. 14B is the same view as FIG. 14A, but taken from the rear.
Figure 15A:
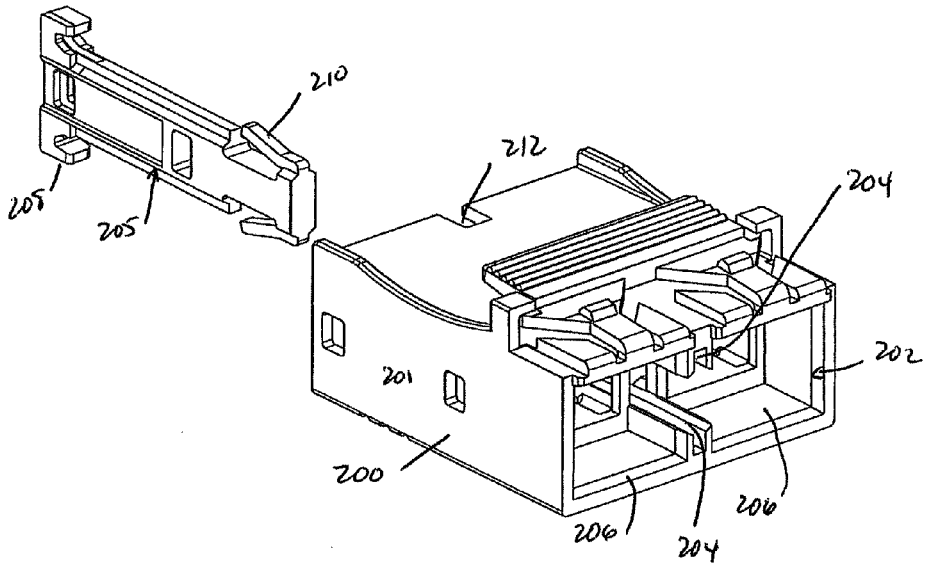
FIG. 15A is the same view as FIG. 14A but with the dividing wall member removed.
Figure 15B:
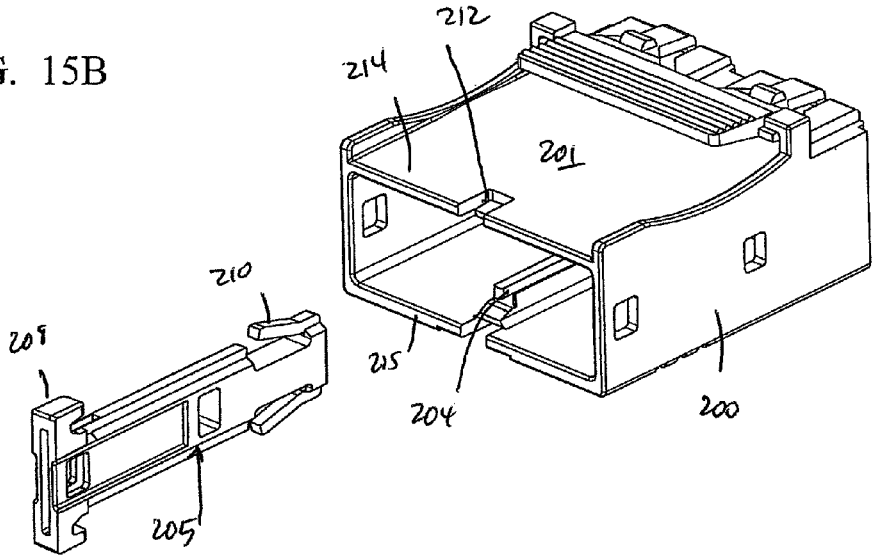
FIG. 15B is the same view as FIG. 15A, but taken from the rear.

In addition to orienting the individual circuit boards 58, 59 with respect to their placement on the spacer 70 and in the resultant cable assembly 68, the spacer 70 also includes a keying, or polarizing, feature in the form of different lengths of the projecting posts 82. The length, or height, of the posts 82*a* on one side of the spacer 70 is different than the length or height of the posts 82*b* or the other side of the spacer 70. In the drawings, the posts 82*a* on the top half of the spacer 70 are shown as taller than the posts 82*b* on the bottom side of the spacer 70. The difference in height of the posts correspond to a like difference in heights of the upper and lower portions of the internal passage 53 after the cable assembly is inserted into the connector housing 51 (FIG. 8). The posts 82*a*, 82*b* during insertion, ride along the interior top and bottom surfaces 130, 131 until the spacer shoulders 96 about the inner stop wall 98. The opening 99 defined by the stop wall 98 of the housing passage 53 is offset inasmuch as the upper and lower portions of the stop wall 98 are of different heights. This and the posts 82*a*, 82*b* orient the cable assembly 68 and its associated circuit boards 58, 59 in place within the connector housing passage 53. If the cable assembly 68 is inserted incorrectly, such as upside down from the orientation illustrated, the taller posts 82*a* will force the circuit cards out of alignment with the opening 99, preventing erroneous assembly. This feature enables the completed assembly 68 to be inserted into the connector housing 51 in only a correct orientation and ensures that the circuit boards 58, 59 and the connector 50 may be easily and properly assembled.

In order to provide the spacer 70 and the cable assembly with a means to engage the connector housing 51, the spacer 70 includes at least one engagement, or latch member 90, with two such latch members 90 being shown in FIGS. 1-11. The latch member 90 is integrally formed with the spacer 70, as by injection molding and is formed in a cantilevered fashion shown best in FIG. 11, which is a horizontal sectional view through the spacer 70 along the level of the tail portion flat surfaces 75. A pair of slots 92*a-b* may be formed at this level as shown in one type of construction, and flank the latch member 90, extending inwardly at an angle, is that the latch members 90 are cantilevered. This provides a desired degree of flexure to the latches 90. Other types of cantilevered construction will also be suitable. Each latch member has an enlarged end portion 93 with an angled forward surface 94 that facilitates insertion of the spacer 70 in the hollow interior 53 of the connector housing 51. Because the latch members 90 are integrally formed with the spacer 70, they cooperatively hold the circuit boards in the most forward position inside of the connector housing 51. The engagement members 89, 90 are received in openings 124 of the connector housing 51 in a manner such that the rear surfaces of the engagement members abut the rear faces 125 of the opening 124.

The enlarged end portion of the cantilevered arms contains molded steps that provide a holding location of the spacer depending on how far forward the spacer is pushed into the housing. Tolerances of components can cause variation in the spacer location, therefore the steps provide a means of always locating the spacer/paddles cards in the most forward location independent of the tolerance stack-up of all the individual components.

The width of the tail portion 73 is less than that of the base portion 72 so as to define an area into which the latch members 90 can deflect. The front face of the spacer 70, and particularly of its base portion 72 is contoured to engage the interior of the connector housing 51. As illustrated, the spacer 70 includes a projecting portion 95 that is flanked by two shoulders 96. The connector housing 51 has an inner stop wall 98 that extends inwardly around the interior of the hollow passage 53 and it includes an opening 99 disposed therein that is smaller in size than its surrounding hollow passage 53. This opening receives the base portion projecting portion 95, and the shoulders steps 96 engage, and preferably abut the stop wall 98. In this regard, the circuit boards 58, 59 have a width that is preferably slightly less than that of the width of the opening 99 so as to project forwardly without interference within the mating receptacle 97 defined by the front of the connector housing 51.

A wire organizer 85 is also provided and includes a block-like member 86 that has a plurality of openings 87*a*, 87*b* disposed therein. The openings 87*a-b* are arranged to accommodate the cables 52 and are so arranged to organize selected cables 52 in an array of rows, or columns, depending on the viewer's frame of reference. In the illustration, as shown best in FIG. 5, four rows of two openings 87*a-b* are shown, with the rows aligned with each other in the vertical direction. These openings 87*a* accommodate the cables 52 containing the differential signal wires 54 and associated drain wire. Each cable 52 contains a pair of signal wires 54*a*, 54*b* which are used to transmit differential signals at high data transmission speeds, and an associated ground, or drain wire 56. The other organizer openings 87*b* accommodate power and other wires 57. In order to provide the organizer 85 with a means for engaging the outer connector housing 51 in a manner so that it is retained within the outer connector housing 51, which includes a plurality of crush ribs 88 that are located on its exterior perimeter in a preselected spacing. As shown, two such crush ribs 88 are positioned on each side of the wire organizer 85. These crush ribs 88 extend outwardly into contact with the interior surfaces of the connector housing inner passage 53. A pair of catches 89 are also preferably provided on two opposite sides of the wire organizer 85 and extend outwardly therefrom. These catches 89 have angled, lead-in surfaces 90 arranged along their front face and a stop or catch surface that extends outwardly generally perpendicularly to the sides of the wire organizer 85.

The openings 87*a-b* are all preferably tapered along the insertion direction of the cables 52, so that the diameter at the rear face 118*a* of the wire organizer 85 is less than the diameter of the openings 87*a-b* at the front face 118*b* of the wire organizer 85. This tapering permits the wire organizer 85 to be slid onto the wires to a point where the openings 87*a-b* thereof snugly engage the cables 52 at one end, while the openings are slightly larger at the other end.

Both the wire organizer 85 and the spacer 70 have flat surfaces 120, 121 that oppose each other and serve to define stop surfaces that cooperatively define the boundaries of an internal area of the cable assembly therebetween, that is injected with a hot melt, typically a thermosetting adhesive, in order to bind the cables 52 together into a group and to add rigidity and mass to the cable assembly to, among other things, facilitate its insertion into an associated connector housing 51. This hot melt, when set, defines a body portion 100 of the cable assembly 68 because it encloses the cable wires 54 in a block to prevent them from deflecting outwardly when the cable assembly 68 is inserted into the connector housing passage 53 as they may be prone to do, given their fixed points at both the wire organizer and the trailing edges of the circuit boards 58, 59. This body portion 100 preferably abuts the wire organizer 85 and the spacer and so prevents movement of the wires 54 in a back and forth direction as would occur if the wires 54 were fixed along their length at two spaced-apart locations such as at the wire organizer 85 and the termination to the circuit boards 58, 59. The use of hot melt is beneficial because of the low application pressures utilized with it. If a thermoplastic were used to form the body portion, the high injection pressures required would crush the insulation of the twinax wires 54 of the cables 52, as well as possibly bleed or flash out onto the termination area on the circuit boards 58, 59, and this would detrimentally affect the impedance of the connector in this area by increasing the capacitance and lowering he impedance to an undesired level.

The body portions 100 also provides strain relief to the wire terminations at the trailing edges 62 of the circuit boards 58, 59, and due to adhesion of the hot melt during the molding process, joins to the wire organizer along its front face 118*b* and into its openings 87*a-b*, and also joins to the flat, rear surface 79 of the spacer 70 and the trailing edges 62 of the circuit boards 58, 59. This, coupled with the termination of the conductor free ends to the termination pads 64, fixes the multiple circuit boards 58, 59 in place within the assembly 68.

In the past, as exemplified by the aforementioned '444 patent, the free ends of the cables wires were terminated to the circuit card(s) in a termination nest area between the walls of a housing perform and then plastic or hot melt formed over the wires, including the exposed conductors terminated to the circuit card. This was done largely to ensure the structural integrity of the resulting connector. However, the plastic has a dielectric greater than that of air and therefore increased the capacitance of the connector in that area, which resulted in a lowering (a "dip") of the impedance in that section of the connector. The dip in the impedance in such a connector proved detrimental in that the dip would result in about an 11-ohm reduction from a peak value of about 103 ohms to a dip value of about 92 ohms. This can be too large of a reduction at high speeds and will tend to introduce noise and crosstalk into the system. The goal in high speed data transmission is to flatten out as much as possible, the typical impedance profile, and prevent large dips and peaks. One standard tolerance ranges is 100 ohm+/−10%, meaning that the boundaries of the impedance profile through the mating interface are desirably about 90 to about 100 ohms. As stated earlier, this may be suitable for data transmission speeds of 1-2 Gbs, but at high speeds, of about 10 to about 12 Gbs and above, noise will be introduced into the system at the mating interface. In connectors of this disclosure, the impedance drop is reduced to a drop of about 8 ohms, with a peak on the profile of about 103 ohms to a dip of about 96 ohms, thereby softening the magnitude of the impedance profile through the cable connector.

FIGS. 12-16C illustrate another connector 200 constructed according to the Present Disclosure, in which the connector housing is in a tandem format which receives two cable sub-assemblies 68. The structure of each cable assembly 68 remains the same, but the connector housing 201 is modified. The connector housing 201 is rectangular in shape and has four walls that are interconnected to cooperatively define a hollow, interior passage 202. The connector housing 201 includes a pair of slots 204 extending lengthwise within the interior passage 202 and the slots facilitate molding of the housing and assembly of the connector 200. A dividing member 205 is provided and it is received within the slots 204. The dividing member 205 defines an inner wall that divides the interior passage 202 into a pair of sub-passages 206, with each such sub-passage 206 receiving a single cable assembly 68 therein.

Figure 16A:
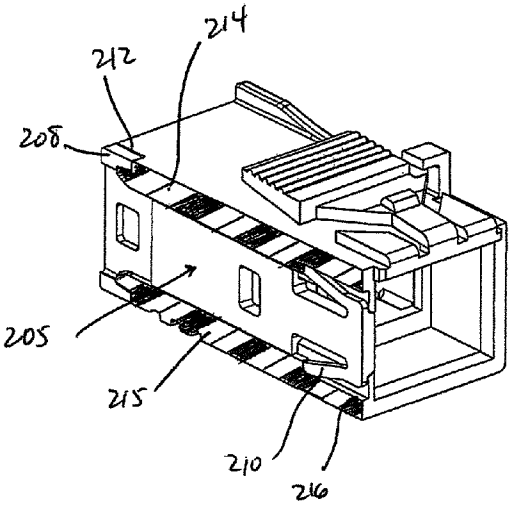
FIG. 16A is a sectional view of the connector housing of FIG. 14A, along Line E-E.
Figure 16B:
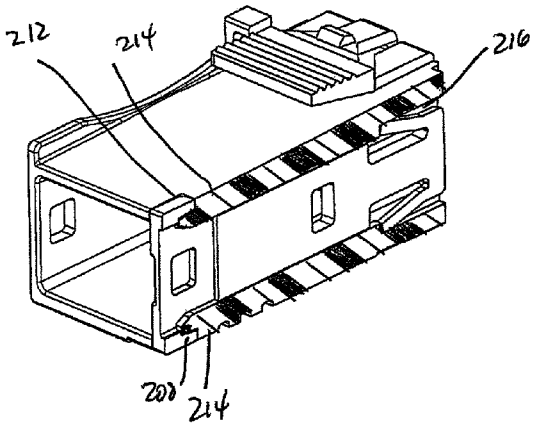
FIG. 16B is a sectional view of the connector housing of FIG. 14B, along Line F-F.
Figure 16C:
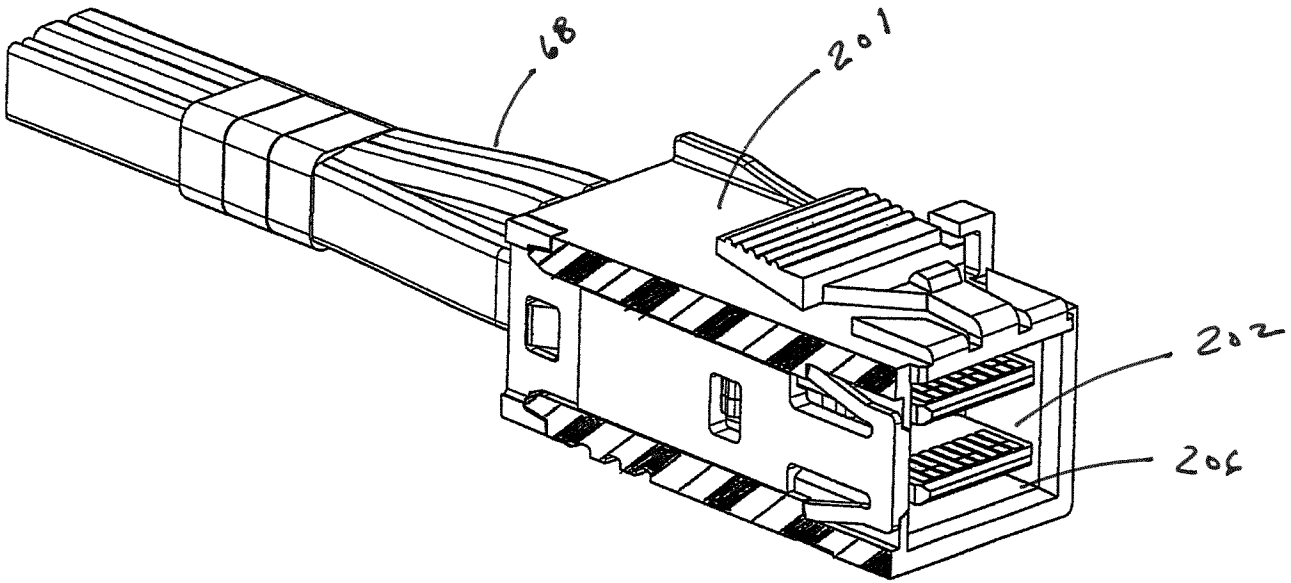
FIG. 16C is a sectional view of the connector of FIG. 12, along Line G-G.

The dividing member 205 is elongated and preferably extends the entire length of the connector housing 201 and it may include engagement members formed at its opposing ends, such as clips 208 and fingers 210. The clips 208 extend into slots 212 formed along the rear face 213 of the connector housing 201, while the fingers 210 are cantilevered projections disposed at the front of the dividing member 205 and which are bent outwardly with respect to a central axis of the dividing member 205. As shown in the sections of FIGS. 16A-C, the connector housing top and bottom walls 214, 15 include recesses 216, positioned within the slots 204, into which the fingers 210 extend and catch against a stop surface 217 thereof to prevent the dividing member 205 from coming loose. Openings 218 are formed therein in alignment with the engagement members 89, 90 of the cable assemblies for engagement therewith.

It will be understood that there are numerous modifications of the Present Disclosure, which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which the Present Disclosure relates and is intended to be within the scope of the following Claims. It is also noted that the use of a singular element in a claim is intended to cover one or more of such an element.

What is claimed is:

1. A cable connector for use with a plurality of wires, comprising:

a hollow connector housing including at least one hollow passage therein for receiving ends of a plurality of cables therein, each of the cables including at least a pair of wires therein and each wire including a conductor surrounded by an insulative jacket;

a cable assembly, including a body portion insertable into the connector housing and holding the wires of the cables together as a mass of wires within the connector housing, with free ends of the wire conductors extending forwardly with respect to the body portion;

a plurality of circuit boards extending forwardly with respect to the body portion, the circuit boards being spaced apart from each other and including opposing mating and termination edges extending in opposing directions, the circuit boards being spaced apart from each other, the wire conductor free ends being terminated to circuits proximate to the circuit board trailing edges; and the cable assembly including a plurality of engagement members for engaging the connector housing and holding the assembly in place within the connector housing.

2. The cable connector of claim 1, wherein the cable assembly includes a spacer that spaces the circuit boards apart from each other.

3. The cable connector of claim 2, wherein the spacer includes two opposing support surfaces, each of the two support surfaces supporting one of the circuit boards thereon.

4. The cable connector of claim 3, wherein the spacer further includes positioning members for positioning the circuit boards on spacer in a preselected position.

5. The cable connector of claim 4, wherein the positioning members permit insertion of the assembly into the connector housing in only a preselected orientation.

6. The cable connector of claim 2, further including a wire organizer that arranges the cable wires in a preselected arrangement.

7. The cable connector of claim 6, wherein the body portion is interposed between the spacer and the wire organizer.

8. The cable connector of claim 6, wherein the engagement members are disposed on the spacer and wire organizer and extend outwardly therefrom into contact with the connector housing.

9. The cable connector of claim 1, further including a wire organizer that arranges the cable wires in a preselected arrangement, the wire organizer abutting the body portion.

10. The cable connector of claim 1, wherein the body portion includes a hot melt that is formed over the wires, the hot melt contacting the wire organizer and spacer, while leaving the wire conductor free ends exposed to air within the cable assembly.

11. The cable connector of claim 1, wherein the wire conductor free ends are terminated to the circuit boards forward of the body portion and are exposed to air within the connector housing.

12. The cable connector of claim 1, wherein the connector housing further includes a dividing wall extending lengthwise through the connector housing hollow passage and dividing the connector housing hollow passage into two hollow subpassages.

13. The cable connector of claim 12, wherein the connector housing further includes a second cable assembly with a second body portion and a plurality of second circuit boards to which cables in the second cable assembly are terminated, the first and second cable subassemblies including respective first and second wire organizers that engage the cable sin each cable assembly and first and second spacers spacing the circuit boards apart on a vertical spacing, the body portions being interposed between the wire organizers and spacers, and the second cable assembly including engagement members for engaging the connector housing and holding the second cable assembly in place therein.

14. The cable connector of claim 13, wherein the dividing wall includes a plurality of openings, each opening receiving at least one engagement member therein.

15. The cable connector of claim 14, wherein the dividing wall includes a pair of latches engaging the connector housing.

16. A spacer for use in a connector that utilizes at least two circuit boards as mating blades for the connector, comprising:

a base portion having at least two support surfaces for supporting the at least two circuit boards thereon, a tail portion extending along an edge of the base portion and away from the base portion, the tail portion having a different thickness than the body portion such that at least two recesses for accommodating conductors of wires of the cable terminated to the circuit boards are defined on the tail portion; and a pair of latch members extending out from the body portions.

17. The connector circuit board spacer of claim 16, further including a pair of positioning posts disposed on the body portion and extending away from at least one of the two support surfaces thereof, the positioning posts being offset from each other to define an area therebetween into which a circuit board may be inserted.

18. The connector circuit board spacer of claim 16, further including a pair of flat end surfaces arranged at respective front and rear ends of the spacer.

19. The connector circuit board spacer of claim 16, wherein the latch members extend from the base portion alongside the tail portion, and are cantilevered from the base portion.

20. The connector circuit board spacer of claim 19, wherein the base portion includes a pair of slots flanking each of the latch members.

21. A cable connector, comprising:

a hollow connector housing including a hollow passage therein for receiving ends of a plurality of cables therein, each of the cables including a pair of wires and an associated drain wire therein, each wire including a conductor surrounded by an insulative jacket;

a cable assembly insertable into the connector housing, the cable assembly including a wire organizer holding the cables together in a preselected arrangement; a body portion formed about the cables and holding the cables together as a mass; a plurality of circuit boards extending forwardly with respect to the assembly body portion, the circuit boards being spaced apart from each other and including opposing mating and termination edges extending in opposing directions, free ends of wires of the cables being terminated to circuits of the circuit board proximate to the circuit board trailing edges; and a spacer spacing the circuit boards apart from each other, the body portion being interposed between the wire organizer and the spacer; and the cable assembly including a plurality of engagement members for engaging the connector housing and holding the assembly in place within the connector housing.

* * * * *